US006988745B2

(12) United States Patent
Trinen et al.

(10) Patent No.: US 6,988,745 B2
(45) Date of Patent: Jan. 24, 2006

(54) GRIP FOR A SPORTS POLE, AND A SPORTS POLE HAVING SUCH GRIP

(75) Inventors: Juha Trinen, Helsinki (FI); Kaarlo Hirvijarvi, Kangasala (FI); Serge Vigny, Thorens-Glieres (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/607,972

(22) Filed: Jun. 30, 2003

(65) Prior Publication Data

US 2004/0012189 A1 Jan. 22, 2004

Related U.S. Application Data

(63) Continuation of application No. 09/744,998, filed as application No. PCT/FR00/01703 on Jun. 21, 2000, now Pat. No. 6,637,773.

(30) Foreign Application Priority Data

Jun. 22, 1999 (FR) ..... 99 008051

(51) Int. Cl.
*A63C 11/22* (2006.01)

(52) U.S. Cl. ..... 280/821; 280/819; 2/160

(58) Field of Classification Search ..... 280/819, 280/821, 822, 823, 816, 809; 2/160
See application file for complete search history.

(56) References Cited

U.S. PATENT DOCUMENTS

| | | | | |
|---|---|---|---|---|
| 4,750,760 A | | 6/1988 | Gurley | 16/DIG. 12 |
| 4,790,562 A | | 12/1988 | Skard | 280/821 |
| 5,092,629 A | | 3/1992 | Bagneres et al. | 280/821 |
| 5,248,163 A | | 9/1993 | Dondero | 280/821 |
| 5,287,870 A | | 2/1994 | Rhodes | 135/65 |
| 5,316,340 A | | 5/1994 | Maltsev | 280/821 |
| 5,887,282 A | | 3/1999 | Lenhart | 2/159 |
| 6,139,060 A | | 10/2000 | Lenhart | 280/821 |
| 6,264,242 B1 | * | 7/2001 | Lenhart | 280/822 |
| 6,305,051 B1 | * | 10/2001 | Cho | 16/430 |
| 6,325,418 B1 | * | 12/2001 | Lenhart | 280/821 |
| 6,386,588 B1 | * | 5/2002 | Young et al. | 280/821 |
| 6,390,109 B1 | * | 5/2002 | Manninen | 135/77 |

FOREIGN PATENT DOCUMENTS

| | | |
|---|---|---|
| EP | 0266329 | 5/1988 |
| EP | 0370900 | 5/1990 |
| FR | 2634388 | 1/1990 |
| NO | 159639 | 1/1989 |
| NO | 167004 | 9/1991 |
| NO | 309846 | 9/2001 |
| WO | WO90/14136 | 11/1990 |
| WO | WO92/04953 | 4/1992 |
| WO | WO02/062434 | 8/2002 |

OTHER PUBLICATIONS

Four photographs of EXEL hand grip.*

* cited by examiner

*Primary Examiner*—Christopher P. Ellis
*Assistant Examiner*—J. Allen Shriver
(74) *Attorney, Agent, or Firm*—Greenblum & Bernstein, P.L.C.

(57) ABSTRACT

A pole, for use in skiing or other sport, of the type that includes a grip handle at its upper end, wherein the handle includes a support extending from its side wall and adapted to cooperate with the thumb of a user, so as to constitute an additional mechanism for the axial transmission of forces, by the thumb, when the hand is closed on the handle of the pole.

20 Claims, 7 Drawing Sheets

GRIP FOR A SPORTS POLE, AND A SPORTS POLE HAVING SUCH GRIP

CROSS-REFERENCE TO RELATED APPLICATIONS

This application is a continuation of application Ser. No. 09/744,998, filed in the U.S. Patent and Trademark Office on Mar. 23, 2001, now U.S. Pat. No. 6,637,773, as a national stage application of PCT/FR00/01703, which had been filed on Jun. 21, 2000, the disclosure of which is hereby incorporated by reference thereto in its entirety and the priority of which is claimed under 35 U.S.C. §120.

This application is also based upon French application No. 99.08051, filed on Jun. 22, 1999, the disclosure of which is hereby incorporated by reference thereto in its entirety and priority of which is hereby claimed under 35 U.S.C. §119.

BACKGROUND OF THE INVENTION

1. Field of the Invention

The present invention relates to a grip or handle of a sports pole, such as a ski pole and, more particularly, a pole of the type having such grip or handle at its upper end.

2. Description of Background and Relevant Information

On sports poles, such as ski poles, the handle, or grip, or grip handle, is generally provided with a closed loop strap known as a wrist strap, which is affixed to the handle, and through which the skier passes his hand in order to avoid losing his pole when he unexpectedly opens his hand on the handle. Another function of the wrist strap is to enable a better transmission of forces, particularly when leaning on the pole, either for making turns in alpine skiing, or for the stride or skating step in cross-country skiing, or yet for in-line roller skating or ice skating, but also for walking.

To be really efficient, a wrist strap must partially encircle the wrist, with the two end strands of the loop connected to the handle passing along the palm of the hand.

However, the majority of skiers, particularly novice skiers, do not position the wrist strap properly, which completely eliminates the efficiency thereof and the effect of its transmission of forces. Moreover, to improve the quality of the impulse force on the pole, the poles used, particularly for cross-country skiing, include a wrist strap that is conventionally connected to the rear surface of the handle. According to this arrangement, the hand takes support on the wrist strap, inwardly in the area of the metacarpus of the thumb, on the thumb muscle. However, this support obtained on a muscle is inefficient and can prove painful for said muscle.

This is the reason why it has already been proposed to integrate the wrist strap into a glove or the like which can be slipped onto the skier's hand, and to connect it to the handle by a removable connecting system constituted by complementary mechanisms arranged on the handle, on the one hand, and on the wrist strap integrated into the glove, on the other hand.

Such a device has been envisioned and described in the commonly owned French Patent Application No. 2 634 388 and related U.S. Pat. No. 5,092,629, and which, by merely putting on the glove or an adequate envelope/sheath provided with an element for connecting to the handle of the pole, makes it possible to obtain an adequate connection between the user's hand and the pole, namely a connection with transmission of forces.

Such an improvement therefore makes it possible to particularly improve the transmission of forces.

The problem of transmission of forces also exists on ski poles or the like which do not comprise a wrist strap.

SUMMARY OF THE INVENTION

Therefore, an object of the present invention is to further improve the existing grips or handles, and to propose an improvement enabling an optimized transmission of forces between the hand and the handle of the pole, especially a ski pole, whether or not the latter is provided with a wrist strap, and whether the wrist strap is integrated into the pole or into the glove. It also has the object of improving the grip and the contact between the hand and the handle of the pole by ensuring a steady and powerful contact.

To this end, the invention relates to a pole, of the type comprising, at its upper end, a grip or handle provided or not provided with a closed loop strap or wrist strap, either affixed to the handle or integrated into a glove or the like that is slipped onto the user's hand and connected to the handle by a removable connecting system constituted by complementary attachment mechanisms arranged on the handle, on the one hand, and on the wrist strap integrated into the glove, on the other hand, wherein the handle includes a support point projecting from its side wall and capable of cooperating in support with the user's thumb, so as to constitute an additional means for axial transmission of forces by the thumb. Such a construction makes it possible to considerably increase the power transmitted when pushing on a pole by also using the thrust force exerted by the thumb. Indeed, the support optimizes the power of the support since it is localized in the area of the first, or proximal, phalanx of the thumb.

In a first embodiment, the support is fixed on the handle of the pole.

In a second embodiment, the support is substantially rotationally movable with respect to the handle so as to better follow the hand movements during the impulse phase on the pole.

The instant invention also relates to characteristics which will become apparent from the description that follows, and which should be considered separately or according to all of their possible technical combinations.

BRIEF DESCRIPTION OF DRAWINGS

The description that follows, provided by way of non-limiting examples, will help to better understand how the invention can be embodied, with reference to the annexed drawings, in which.

DETAILED DESCRIPTION OF THE INVENTION

Figure 1:
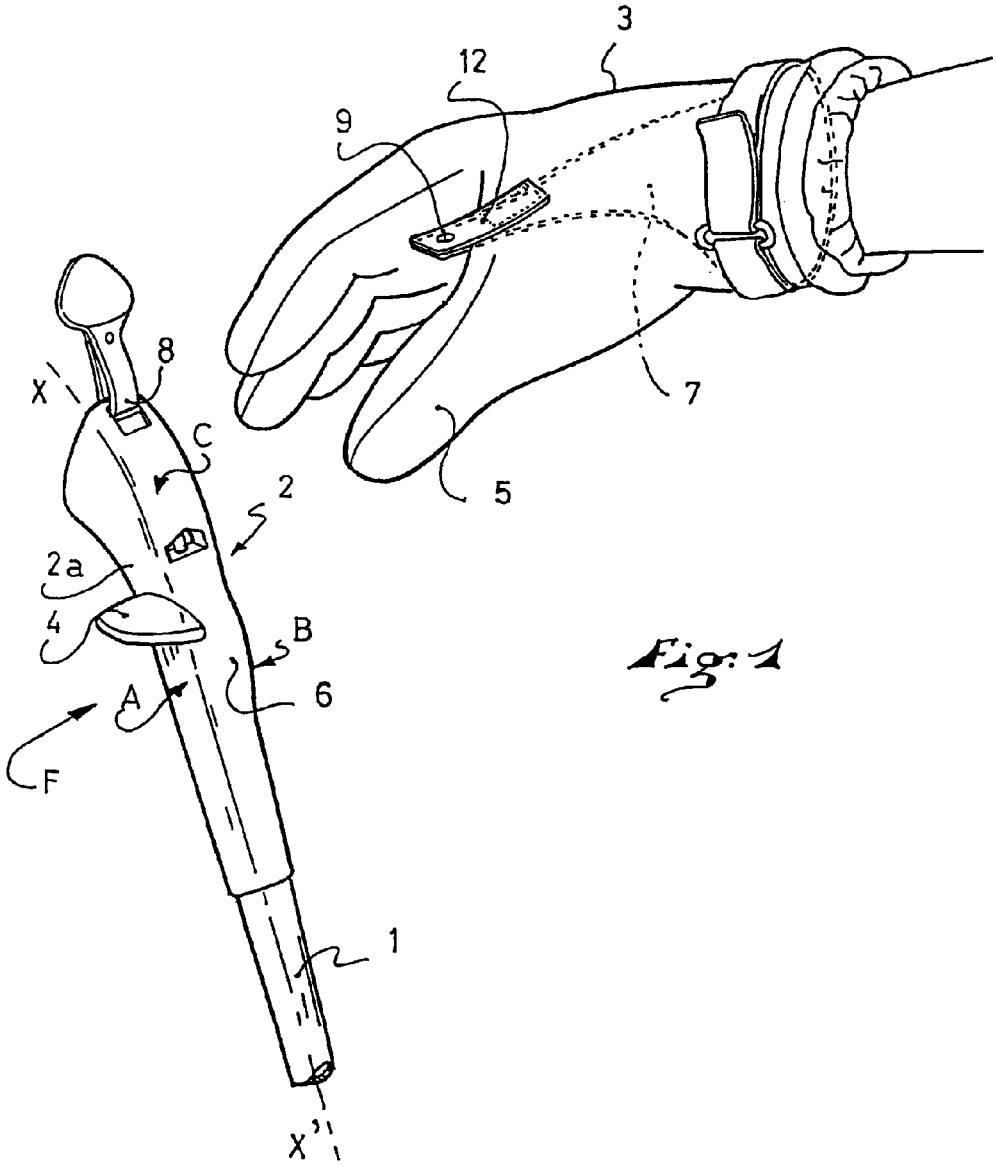
FIG. 1 is a perspective view of the end of a ski pole equipped with a grip or handle adapted to the right hand, according to the first embodiment of the invention.

FIG. 1 shows an example of an application of the invention to a pole, in this case a ski pole 1 that comprises a grip 2, or handle, or grip handle, which embodies an object of the invention, adapted to be grabbed by the user's hand onto which a glove 3 has preferably been slipped. As shown, the grip/handle 2 is positioned on the end portion of the ski pole 1.

Generally speaking, the handle 2 has a peripheral wall 2*a* that can take the form of a generally substantially cylindrical element. The handle 2 comprises a support point 4, extending laterally from its side wall 2*a* and adapted to cooperate in support with the thumb 5 of the user, so as to constitute an additional means for axial transmission of forces, by the thumb 5, for a natural position of the latter when the hand is closed on the handle 2 of the pole 1. "Support point" or "support" in this context means a zone, not necessarily localized, which is adapted to serve as a support for the thumb.

More specifically, the support point 4 of the thumb 5 extends so as to project substantially perpendicular to the longitudinal axis XX' of the handle 2, from an intermediate zone of the side wall 2*a* of the handle 2, in the manner of a prop.

This support point 4 of the thumb 5 is configured on its substantially rounded tile-like upper portion whose curve is directed upward, i.e., the upper portion has a convex upper surface, so as to assume the shape of the thumb 5 when the hand is closed on the handle 2 during the sport activity.

As clearly shown in the drawing figures, the support point 4 is also inclined angularly toward the rear with respect to the longitudinal axis XX' of the handle 2, so as to perfect the ergonomics of the latter in the area of the thumb 5, when the hand is closed.

Figure 2:
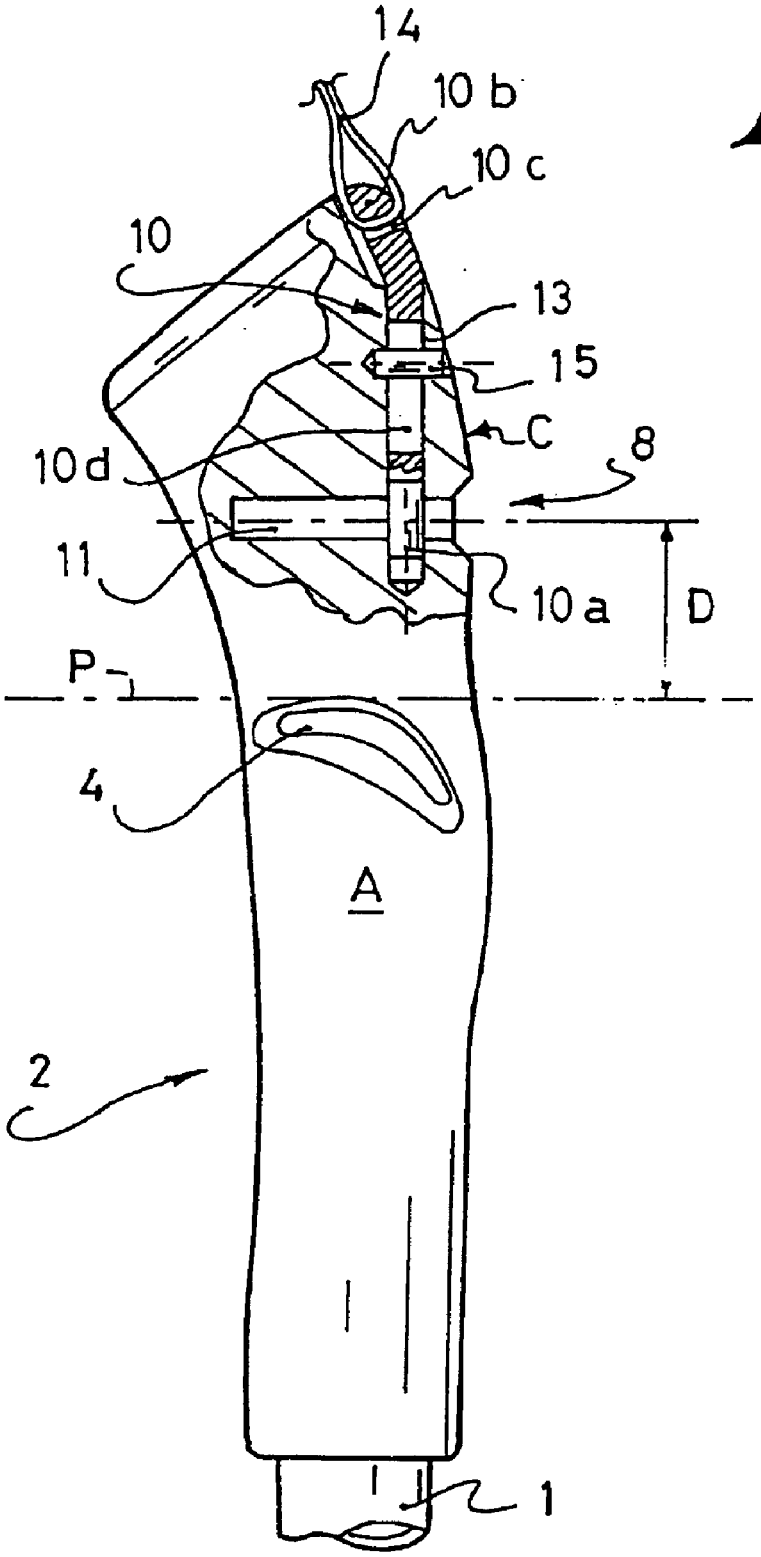
FIG. 2 is a side view of the handle, along the arrow F of FIG. 1.
Figure 3:
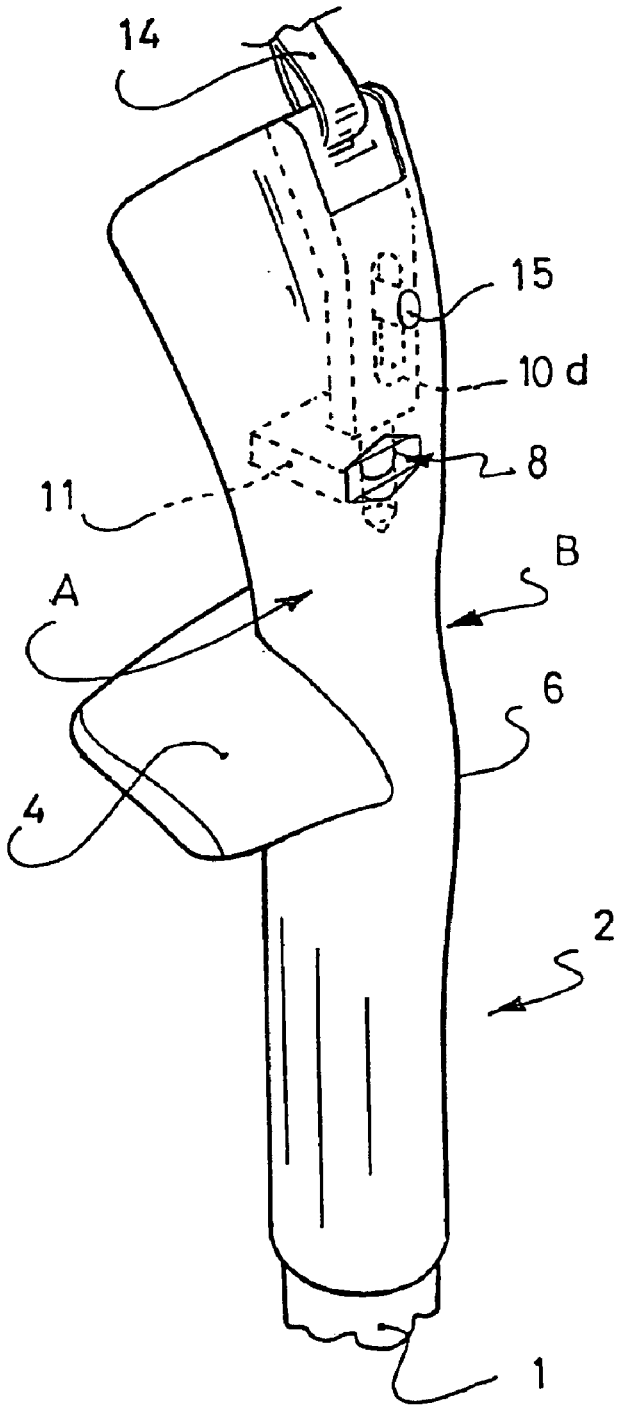
FIG. 3 is a slightly enlarged perspective view of a handle according to FIG. 1.

According to another characteristic of the invention, a zone B of the side wall 2*a* of the handle 2, substantially opposite of zone A from which the support 4 of the thumb 5 emerges, has a convexity 6 whose shape and dimensions are provided so that it is housed ergonomically in the palm of the user's hand when the thumb 5 is in contact with its support point 4 for a closed position of the hand around the handle 2. As shown in FIG. 1, the aforementioned convexity 6 is localized in zone B. FIGS. 1–3 also show, in a non-limiting manner, that the upper end of the grip/handle 2 is curved upwardly and away from the user, as it is held during the sport activity. Also, the upper end of the grip/handle 2 becomes progressively enlarged in a direction extending upwardly from the thumb support 4.

The handle 2 is ergonomically configured such that it is adapted to the right hand or to the left hand of the skier, the support point 4 being located, as seen by the skier, to the left, and the convexity 6 to the right, for a right hand.

Conversely, for a left handle, the support point 4 is located to the right, as still seen by the skier, and the convexity 6 is located to the left.

In this case, the drawing figures shown relate to a right hand handle.

According to a particular application of the invention to skiing, shown in the drawing figures, a wrist strap 7 is integrated into the glove 3 adapted to be slipped onto the hand of a skier, and connected to the handle 2 by a removable connecting system constituted of complementary mechanisms 8, 9 arranged on the handle 2, on the one hand, and on the wrist strap 7 integrated into the glove 3, on the other hand.

In this case, one of these complementary mechanisms 8 located on the handle 2 is provided in a zone C along a direction that is substantially perpendicular to the zones A and B in which the support point 4 of the thumb 5 and the convexity 6 of the handle 2 are provided, i.e., a zone C that is directed toward the user's arm when he grabs the pole 1.

For information, a wrist strap integrated into a glove is described in the commonly owned French Patent Application No. 2 634 388 and related U.S. Pat. No. 5,092,629.

More specifically, the complementary connecting mechanism 8 of the handle 2 is raised with respect to the support plane P (see FIG. 2) defined by the support point 4 of the thumb 5, so as to be located substantially at the level of the mutual rotation zone of the hand in relation to the handle/ski pole, so as to avoid phenomena such as blisters due to the relative sliding of these elements during their mutual rotation and to enable an optimum transmission of forces.

Tests have shown that a distance D of about 20 millimeters (mm) between the upper support plane P of the support point 4 and the axis 8*a* of the complementary connecting mechanism 8 of the handle 2 constitutes an optimum distance as a function of various users, and in fact provides the skier with a preadjusted position of the elements with respect to one another, namely, the wrist strap 7, the connecting mechanism 8 and the thumb support point 4.

According to a preferred embodiment, the complementary mechanism 8 of the handle 2 for connecting to the one adapted to cooperate with the connecting mechanism 9 of a wrist strap 7 is constituted by an immobilizing element 10 adapted to be displaced in a substantially horizontal housing 11 provided as a recess in the handle 2, and in which a free end 12 of the wrist strap 7 carrying the complementary mechanism 9 for cooperating fixedly with the element 10 is adapted to be introduced.

The immobilizing element 10 is constituted by a slide adapted to be driven in vertical translation in a corresponding housing 13, having a substantially vertical axis, provided in an upper portion of the handle 2, and one end of which extends into the housing 11. One end of the slide 10 forms a point 10*a*, or lower end, adapted to be engaged in a corresponding hole (see FIG. 1) of the free end 12 of the wrist strap 7 which constitutes the complementary connecting mechanism 9 of the latter, whereas the other end 10*b* of the slide 10 is directed opposite towards the upper portion of the handle 2, to constitute a grip of the slide 10 in a direction in which the wrist strap 7 is immobilized or released.

In fact, the housing 11 extends transversely within the handle 2 and has a shape and dimension that are substantially identical to the end 12 of the wrist 7 that must be introduced therein to be immobilized.

The slide 10 also comprises, in the vicinity of its upper end portion 10*b*, a hole 10*c* adapted to the insertion of a flexible grip element 14 that is formed by a link or a strap, in order not to create a dangerous rigid projecting element during skiing, the slide 10 then being completely retracted in the latching position of the wrist strap 7.

The slide 10 also comprises an oblong slot 10*d* whose upper and lower ends constitute abutments in either sliding direction, with respect to a fixed pin 15 extending through the handle.

FIGS. 4–10 show a grip handle 2 mounted on a pole 1 that is adapted more specifically to cross-country skiing, in-line roller skating, ice skating and walking, and more generally to all sporting activities in which the user takes support on the pole, when the hand is closed on the handle 2, but also when the hand is not closed on the handle 2. This last position corresponds to the end of support on the pole 1 when the pole 1 is positioned behind the user. To achieve this result, the support point 4 is mounted substantially pivotally with respect to the handle 2.

Figure 4:
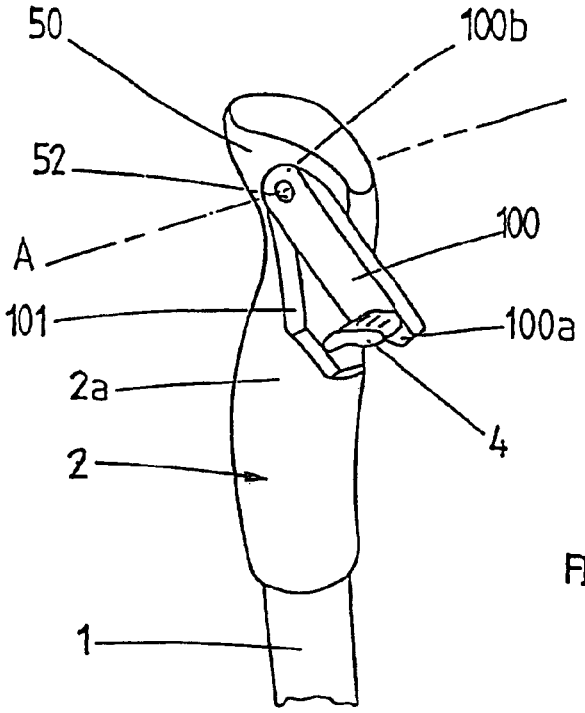
FIG. 4 schematically shows a rear perspective view of a pole handle according to the second embodiment.

In FIG. 4, the support point 4 is affixed to a rocker 100 and is positioned at the lower end 100*a* of said rocker 100. The rocker 100 is fixed, at the level of its upper end 100*b*, to the side wall 2*a* of the handle 2. Moreover, the handle 2 includes a hinge connection mechanism 52 that hingedly maintains the rocker 100 on the handle 2, about an axis A that is substantially perpendicular to the lateral portion 2*a* of the handle 2, i.e., transverse to the longitudinal extent of the pole 1. Thus, the rocker 100 pivots toward the rear of the handle 2 so as to move away from its position along the side wall 2*a* of the handle 2. So that the support point 4 constantly remains in support with the thumb of the hand during the entire impulse phase on the pole 1, the axis A is located in the upper portion 50 of the handle 2, i.e., above the support point 4, when the rocker 100 is in position substantially along the side wall 2*a* of the handle 2. Physiological tests and tests on comfort of the support have shown that the optimum distance between the support point 4 and the axis A along the rocker 100 is about 20 mm.

To prevent the rocker 100 from projecting with respect to the handle 2, the handle 2 includes, in the area of its lateral surface 2*a*, a reinforcement 101 that is complementary of the rocker 100 when the latter is in position along the lateral surface 2*a*. The depth of the reinforcement 101 is substantially equal to the thickness of the rocker 100 so as to obtain a substantially continuous surface on the lateral surface 2*a* when the hand is closed on the handle 2.

The rocker 100 and the support point 4 can be made of a thermoplastic material, especially ABS or polyethylene about 1–3 mm thick in the area of the rocker 100. Moreover, the hinge connection mechanism 52 can advantageously be constituted of a screw that is mounted substantially perpendicular in the lateral surface 2*a* of the handle 2.

The handle 2 can be equipped with a conventional wrist strap, not shown, or with a wrist strap integrated into the glove, as described previously. In this case, the fastening of the wrist strap on the handle 2 is advantageously positioned so as to be raised to the height defined by the axis A.

FIGS. 5–10 show variations of the second embodiment of the invention, in which the support point 4 is provided by a wrist strap 51 with which the handle 2 is equipped. The support point 4 provided is of the flexible type, therefore slightly less efficient than the previously described rigid supports. However, these variations have the advantage of being much less expensive to implement and of adapting to the specific morphology of the hand of each user by making it possible to vary the distance between the support point 4 and the axis of rotation A.

Figure 5:
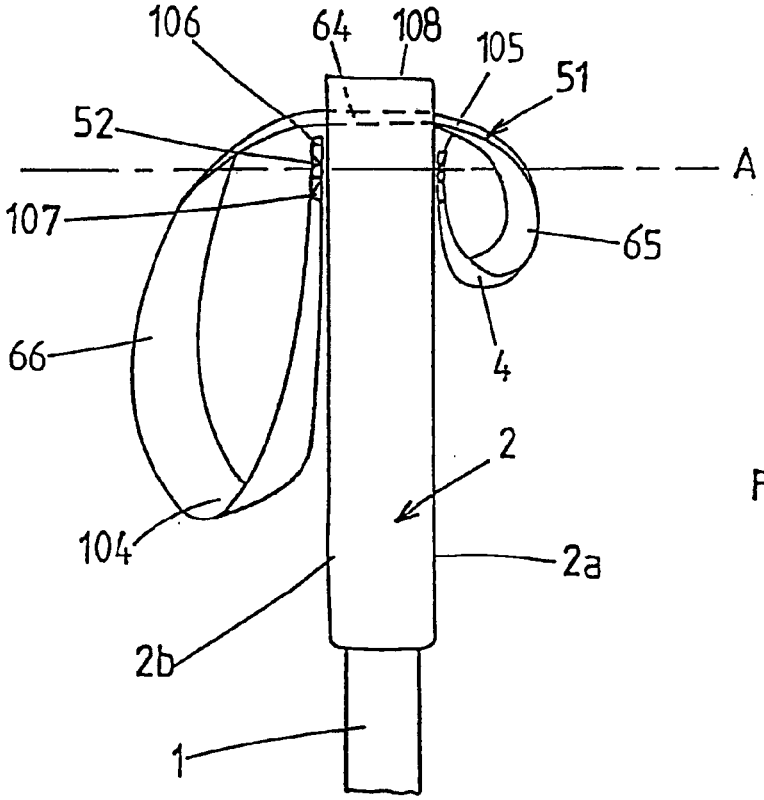
FIG. 5 schematically shows a front view of a pole handle according to a first variation of the second embodiment.

FIG. 5 shows a front view of the handle 2 according to a first variation in which the wrist strap 51 is mounted pivotally with respect to the handle 2, about an axis A that is oriented substantially perpendicular with respect to the side wall 2*a* of the handle 2, i.e., transverse to the longitudinal extent of the pole 1. The wrist strap 51 includes, at its two ends 105, 106, a contact zone 107, such as a rivet, adapted to cooperate with the attachment mechanism 52 of the handle 2. The wrist strap 51 extends from the end 105 to form an inner portion 65, on the one hand, and from the end 106 to form an outer portion 66, on the other hand. The two portions 65, 66 are connected by an upper zone 64 that is located substantially on top of the wrist strap 51, positioned substantially between the top 107 of the handle 2 and the axis A, and positioned at the rear of the handle 2. The inner portion 65 constitutes a loop that is located on the side wall 2*a* and includes, in its lowermost portion, the support point 4 adapted to cooperate with the thumb by passing beneath the thumb. Similarly, the outer portion 66 forms a loop, located on the outer side wall 2*b* and which includes, in its lower portion, a support point 104 adapted to cooperate with the edge of the palm of the hand by passing beneath such edge.

Figure 6A:
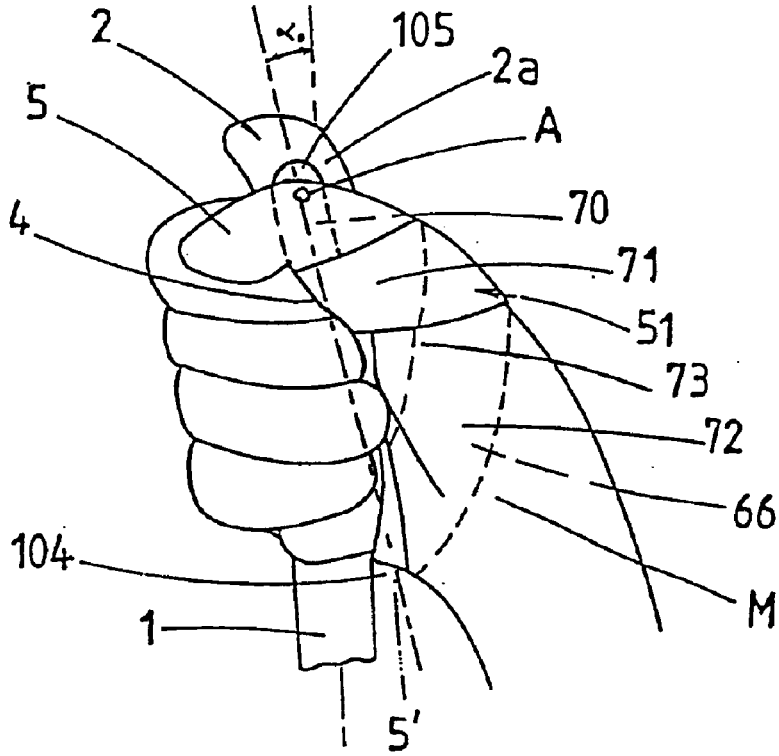
FIGS. 6*a* and 6*b* schematically show a side view of the handle according to FIG. 5 in two positions during the impulse phase on the pole.
Figure 6B:
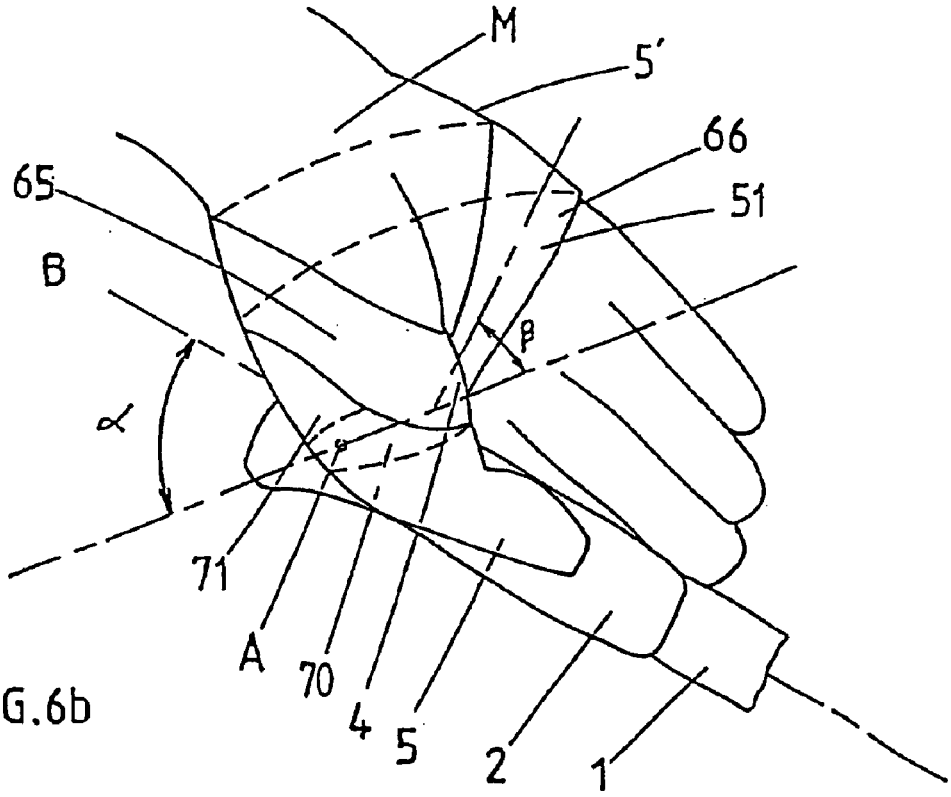

FIGS. 6*a*, 6*b* show in detail the inner side of the handle 2 equipped with the wrist strap 51, such as previously described in FIG. 5, with the right hand M inserted in the wrist strap 51. FIG. 6*a*, where the hand M is closed on the handle 2, shows the beginning of the impulse phase on the pole 1. FIG. 6*b* shows the end of the impulse phase on the pole 1, where the hand M is not closed on the handle 2 but is still in support on the pole 1 via the wrist strap 51. The portions of the wrist strap 51 that are hidden by the hand M or the thumb 5 are shown in broken line.

In FIG. 6*a*, the handle 2 includes a wrist strap 51 that cooperates with the thumb 5 so as to constitute the support point 4. The wrist strap 51, which is mounted pivotally on the handle 2 about the axis A, includes an inner branch 70 that extends downwardly along the side wall 2*a* of the handle 2, from the end 105 substantially up to the support point 4. Thus, the support point 4 is localized in the area of the proximal phalanx 71, and/or of its joint 73 which connects the metacarpus 72 to the proximal phalanx 71 of the thumb 5, in the area where the wrist strap 51 partially surrounds the thumb 5. The support of the hand M on the pole 1 is completed by the outer portion 66 of the wrist strap 51 that passes at the level of the support point 104 beneath the edge 5' of the palm of the hand M.

The wrist strap 51 and its inner branch 70 are substantially aligned with the handle 2 of the pole 1, even if the inner branch 70 has a residual angle $\alpha_0$ with respect to the axial axis of the pole 1. Tests have shown that this residual angle $\alpha_0$ has a value that is usually comprised between 0° and 10° when the hand M is closed on the handle 2.

In FIG. 6*b*, the hand M is substantially positioned along the axis B of the pole 1. As the wrist strap 51 is mounted pivotally with respect to the handle 2, the wrist strap 51 can follow the movement of the hand M by remaining in close contact with the latter. To achieve this result, the outer portion 66 of the wrist strap 51 that surrounds the edge 5' of the palm of the hand M is advantageously flexible. Thus, the wrist strap 51 pivots along the angle $\alpha$ having a value comprised approximately between 30° and 50°, and the wrist strap 51 becomes deformed in the area of the outer portion 66 so as to be off-centered with respect to the inner branch 70 having an angle $\beta$ of a value comprised approximately between 40° and 60°. Respecting this constructional arrangement makes it possible to obtain a support point 4, in the area of the inner portion 65 that surrounds the thumb 5 substantially in the area of the proximal phalanx 71, which follows by deforming the deformations of the palm of the hand M. Advantageously, the wrist strap 51 can be obtained as a strap. The wrist strap 51 can be made of a rigid or semi-rigid material, such as a thermoplastic material, the rotation then occurring solely along the axis A.

FIG. 6*b* also shows another advantage of the present invention regarding the position of the hand M with respect to the pole 1. Indeed, the hand M is positioned very high up on the pole 1, unlike the other existing and known wrist strap systems, which makes it possible to increase the forward displacement obtained by the user with respect to the base of the pole 1 during the impulse phase.

Figure 7:
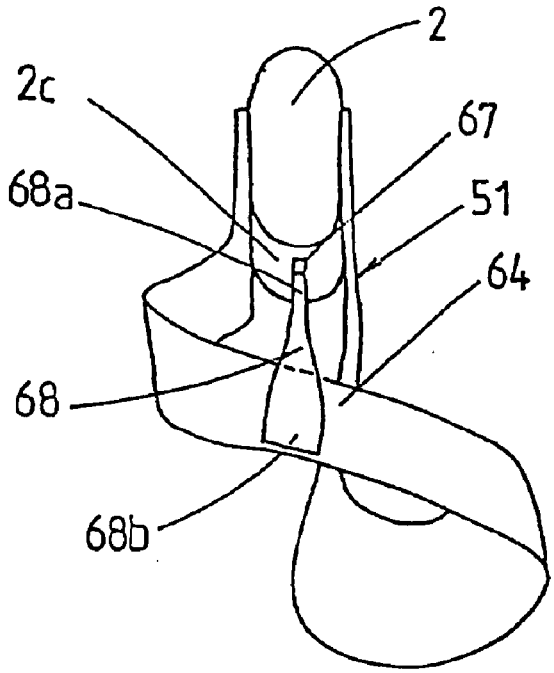
FIG. 7 schematically shows a top view of an alternative construction of the pole handle according to FIG. 5.

FIG. 7 shows an improvement to the previously described wrist strap 51. The grip handle 2, shown here from the top, includes a fastening mechanism 67 adapted to cooperate, via a link 68, with the upper zone 64 of the wrist strap 51. The fastening mechanism 67 can be, in particular but in a non-limiting manner, a vertical slit located on the rear surface 2C and in the upper portion of the handle 2. This fastening mechanism 67 corresponds in particular to the known fastening of the conventional wrist strap on the pole handle. Similarly, the link 68, which is fixed by its end 68*a* to the fastening mechanism 67, is connected to its other end 68*b* at the upper zone 64 of the wrist strap 51. The attachment of the link 68 to the wrist strap 51 can be fixed, such as with a seam, or can be detached and repositioned, such as an attachment of the self-gripping type, which enables an adjusting of the distance between the top of the wrist strap 51 and the handle 2. The link 68 can advantageously be elastic, and in particular can be obtained, in a non-limiting manner, as an elastic strap in order to adapt to the deformations of the hand M during the user's impulse movement on the pole 1.

Figure 8:
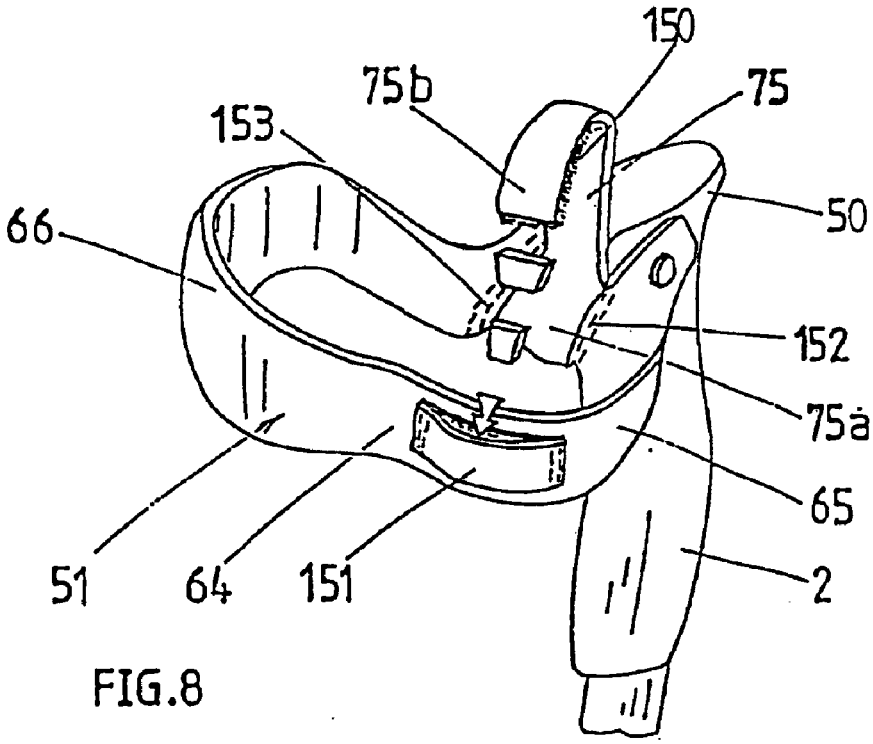
FIG. 8 schematically shows a rear perspective view of a second alternative construction of a pole handle of the type shown in FIG. 5.

FIG. 8 shows another alternative construction of the previously described wrist strap 51, which is illustrated here to cooperate with the user's left hand. The wrist strap 51 includes a connecting piece 75 that connects at least one of the portions 65, 66 of the wrist strap 51 to its upper zone 64. In the preferred embodiment shown here, the connecting piece 75 is fixed, in the area of one of its ends 75*a*, by appropriate means such as seams 152, 153 to the inner 65 and outer 66 portions, respectively. The connecting piece 75 is advantageously positioned between the adjacent edges of the two portions 65, 66, and as close to the handle 2 of the pole as possible. The other end 75*b* of the connecting piece 75 includes an attachment mechanism 150 that can be detached and repositioned, particularly of the self-gripping type, which cooperates with the upper zone 64 of the wrist strap 51. The end 75*b* of the connecting piece 75 can advantageously pass in a tunnel 151 fixed on the upper zone 64 of the wrist strap 51, such that the tunnel 151 includes a fastening mechanism complementary of the attachment mechanism 150. Thus, the end 75*b* is fixedly maintained in the tunnel 151 along the trajectory illustrated by the arrow shown in FIG. 8 in an interrupted manner.

The alternative embodiments of the wrist strap 51, which are shown in FIGS. 7 and 8, make it possible to maintain the upper zone 64 of the wrist strap 51 in a position that is close to the upper portion 50 of the handle 2. They ensure that the wrist strap 51 is in an optimum position on the hand M of the user, in particular so that the inner portion 65 properly surrounds the thumb 5 in the area of the proximal phalanx 71 and/or of the joint 73. Indeed, in the absence of a connecting piece 75 or of a link 68, the wrist strap 51 runs the risk of progressively sliding rearwardly on the hand M, by moving away from the handle 2 during numerous impulse phases.

Figure 9:
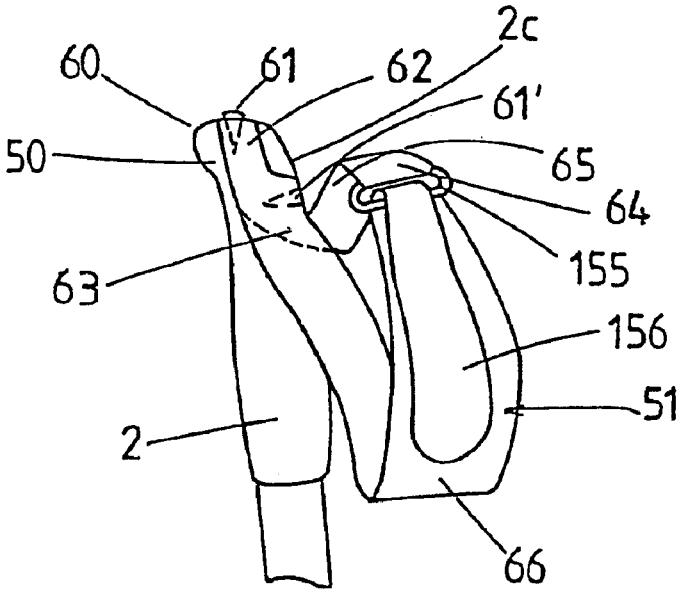
FIG. 9 schematically shows a side view of a pole handle according to a second variation of the second embodiment.

FIG. 9 shows a wrist strap 51 associated with a handle 2 that is adapted to cooperate with the user's left hand. The wrist strap 51 is mounted substantially pivotally with respect to the grip handle 2. However, the pivoting is not obtained by a pivoting attachment mechanism as in the previously described embodiments. The pivoting is obtained by the deformation of a flexible portion of the wrist strap 51. To achieve this result, the handle 2 includes on its upper surface 60 a fastening mechanism 61 that cooperates with at least one fastening zone 62 of the wrist strap 51. Moreover, the wrist strap 51 includes at least one flexible element 63 that is located in the vicinity of the fastening zone 62, which makes it possible to ensure the pivoting of the wrist strap 51. The fastening mechanism 61 can be obtained by means of a screw, and the fastening zone 62 can be symmetrical so as to extend on both sides of the handle 2 by the inner 65 and outer 66 portions. The wrist strap 51 can advantageously be fixed to the handle 2 by a complementary fastening mechanism 61' positioned in the upper zone 50 of the handle 2 and on its rear surface 2*c*.

In the preferred embodiment shown in FIG. 9, the wrist strap 51 includes an adjusting mechanism so as to adapt to the morphology, in particular to the volume and perimeter of the user's hand. The adjusting mechanism is advantageously positioned in the vicinity of the upper zone 64 so as to simultaneously adjust the length of the inner portion 65 and of the outer portion 66 of the wrist strap 51. The outer portion 66 of the wrist strap 51 is extended by a lug 156 that passes in the return 155, then returns toward the outer portion 66. The lug 156 is fixed to the outer portion 66 by a removable attachment mechanism, particularly of the self-gripping type. Other known adjusting systems are suitable to the invention, and this improvement applies to all the embodiments and alternative embodiments of the present invention.

Figure 10:
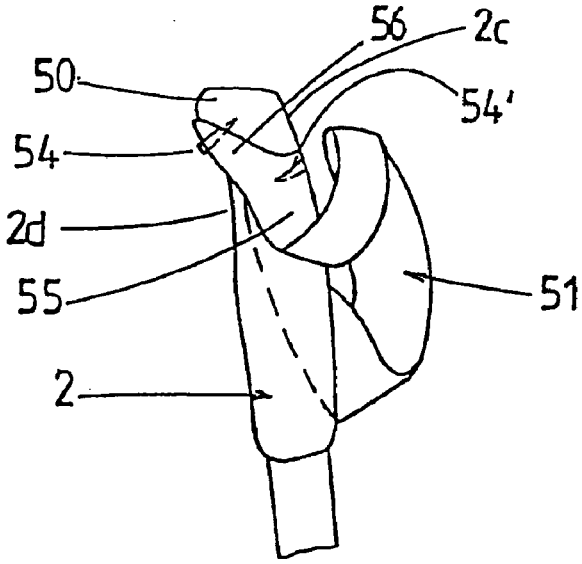
FIG. 10 schematically shows a side view of a pole handle according to a third variation of the second embodiment.

FIG. 10 shows a wrist strap 51 associated with a handle 2 adapted to cooperate with the user's right hand. The pivoting of the wrist strap 51 is also obtained by a deformation of the wrist strap 51. To achieve this result, the handle 2 includes, on its front surface 2*d* and in the top portion 50, a fastening mechanism 54 that cooperates with at least one fastening zone 56 of the wrist strap 51. Moreover, the wrist strap 51 includes at least one flexible element 55 that is located in the vicinity of the fastening zone 56, and which makes it possible to ensure the pivoting of the wrist strap 51. The flexible element 55 can advantageously be constituted of the wrist strap 51 if the latter is constituted of a flexible element such as a strap. Similarly, the fastening of the wrist strap 51 can be completed by a complementary fastening mechanism 54' located on the rear surface 2*c* and in the top portion 50 of the handle 2.

The present invention also relates to the grip handle considered as such.

The present invention is not limited to the embodiments described hereinabove, which are provided for guidance only, but encompasses all similar or equivalent embodiments.

What is claimed is:

1. A grip handle for an axially extending sports pole, said grip handle comprising:

a peripheral wall adapted to surround an upper end portion of the sports pole;

a thumb support extending from said peripheral wall for enabling transmission of an axially directed force to the pole with a thumb of the hand of a user, while allowing a mutual rotation of said peripheral wall between the hand of the user and said peripheral wall about an axis extending through said peripheral wall;

said peripheral wall extending along an axis curved upwardly and away from the user, as the grip handle is held during the sport activity.

2. A grip handle according to claim 1, wherein:

said thumb support constitutes a proximal phalanx thumb support.

3. A grip handle according to claim 1, wherein:

the thumb support comprises a thumb support surface extending away from said peripheral wall along a substantially straight line to a remote end of the thumb support.

4. A grip handle according to claim 1, wherein:

said peripheral wall extending upwardly without an obstruction projecting outwardly from said peripheral wall above said thumb support.

5. A grip handle for an axially extending sports pole, said grip handle comprising:

a peripheral wall adapted to surround an upper end portion of the sports pole;

a thumb support extending from said peripheral wall for enabling transmission of an axially directed force to the pole with a thumb of the hand of a user, while allowing a mutual rotation of said peripheral wall between the hand of the user and said peripheral wall about an axis extending through said peripheral wall;

said peripheral wall being curved upwardly and away from the user, as the grip handle is held during the sport activity; and said peripheral wall being progressively enlarged in a direction extending upwardly from said thumb support.

6. A sports pole comprising:

an axially extending upper end portion;

a grip handle at the upper end portion of the sports pole, said grip handle comprising a side wall and a proximal phalanx thumb support extending from said side wall for enabling transmission of an axially directed force to the pole with a proximal phalanx of a thumb of a user;

said grip handle further comprising a wrist strap, said wrist strap including an inner branch extending downwardly along said side wall of said grip handle, at least to said support for the thumb, said wrist strap providing said support for the thumb.

7. A sports pole according to claim 6, wherein:

said side wall has an intermediate zone;

said support for the thumb extends so as to project from said intermediate zone of said side wall of said grip handle.

8. A sports pole according to claim 7, wherein:

said grip handle extends along a longitudinal axis; and said support for the thumb is inclined angularly and rearwardly with respect to the longitudinal axis of said grip handle during use of the sports pole.

9. A sports pole according to claim 6, wherein:

said support for the thumb has a rounded convex upper surface so as to conform to a curvature of a surface of the thumb in engagement with said upper surface when a hand of the user is closed on said grip handle during use of the sports pole.

10. A sports pole according to claim 6, wherein:

said grip handle further comprises an opposite side wall, said opposite side wall being opposite to said side wall of said thumb support;

said opposite side wall has a zone with a convexity, said convexity of said zone of said opposite side wall having a shape and dimensions to be housed ergonomically in a palm of the user's hand in a closed position of the hand of the user around the grip handle, while the thumb of the user is engaged with said thumb support.

11. A sports pole according to claim 10, wherein:

said grip handle has either a right hand configuration for a right hand of the user or a left hand configuration for a left hand of the user;

said right hand configuration of said grip handle comprises, when viewed by the user, said thumb support extending from a left side of said grip handle and said convexity being on a right side of said grip handle;

said left hand configuration of said grip handle comprises, when viewed by the user, said thumb support extending from a right side of said grip handle and said convexity being on a left side of said grip handle.

12. A sports pole according to claim 6, wherein:

said wrist strap surrounds the thumb of the user, at least partially, in an area of a proximal phalanx of the thumb and/or of a joint connecting the proximal phalanx of the thumb and a metacarpus of the thumb.

13. A sports pole according to claim 6, wherein said sports pole is a ski pole.

14. A sports pole according to claim 6, wherein:

said grip handle comprises a side wall and a proximal phalanx thumb support extending from said side wall for enabling transmission of an axially directed force to the pole with a proximal phalanx of a thumb of a user when the user's hand is closed upon said grip handle during use of the sports pole.

15. A sports pole according to claim 6, wherein:

said proximal phalanx support has a width, extending along said side wall, sufficient to support only the proximal phalanx of the thumb of the user.

16. A sports pole according to claim 6, wherein:

the proximal phalanx thumb support comprises a surface extending away from said side wall along a substantially straight line to a remote end of the proximal phalanx thumb support.

17. A sports pole according to claim 6, wherein:

said side wall extends upwardly without an obstruction projecting outwardly from said side wall above said proximal phalanx thumb support.

18. A sports pole comprising:

an upper end portion extending along a longitudinal axis;

a grip handle at the upper end portion for gripping with a hand of a user, said grip handle comprising a first side wall and a second side wall, and a thumb support extending from said first side wall for enabling transmission of an axially directed force to the pole with a thumb of the hand of a user, said first side wall extending upwardly without an obstruction projecting outwardly from said side wall above said thumb support; and a strap for connecting the hand of a user to said grip handle while allowing an unobstructed mutual rotation between the hand of the user and said grip handle;

said strap being connected to said grip handle by means of a pivotal connection for facilitating said mutual rotation between the hand of the user and said grip handle from a beginning of an impulse phase on the sports pole, whereby the hand of the user is closed on said grip handle, to an end of the impulse phase on the sports pole, whereby the hand of the user is not closed on said grip handle.

19. A sports pole according to claim 18, wherein:

said thumb support constitutes a proximal phalanx thumb support.

20. A sports pole according to claim 18, wherein said sports pole is a ski pole.

* * * * *